US005115821A

United States Patent [19]

Grooms, Jr.

[11] Patent Number: 5,115,821

[45] Date of Patent: May 26, 1992

[54] CIGARETTE INCENSE ASHTRAY HOLDER

[76] Inventor: Dennis B. Grooms, Jr., 1075 Castleton Ave. 2C, Staten Island, N.Y. 10310

[21] Appl. No.: 182,241

[22] Filed: Apr. 15, 1988

[51] Int. Cl.[5] ..... A24F 19/00; A24F 19/10

[52] U.S. Cl. ..... 131/238; 131/231

[58] Field of Search ..... 131/361, 365

*Primary Examiner*—V. Millin

[57] ABSTRACT

An ashtray comprising one or more incense holders. The holder is crimped and can be made out of the same material as the ashtray. The incense holder can also be a separate element and attached to the ashtray. Inside the holder there is employed cork or hard rubber so as to aid in holding the incense stick.

2 Claims, 1 Drawing Sheet

CIGARETTE INCENSE ASHTRAY HOLDER

BACKGROUND OF THE INVENTION

The invention pertains to a cigarette ashtray with an incense holder attached thereto. Incorporated herein by reference is Pat. No. 4,700,721 patented on Oct. 20, 1987. This patent was issued to the applicant of this application and subjected matters were directed to Cigarette Incense Ashtray Holder. This application is directed to improvements over that patent.

SUMMARY OF THE INVENTION

The ashtray comprises one or more incense holders. The holder is crimped and could be made out of the same material as the ashtray. The incense holder can also be a separate element and attached to the ashtray by adhesive means, cohesive means, hook and loop fasteners, magnets, etc. If the holder is not crimped, the holder contains a material that can be pierced or penetrated by the incense stick and hold the incense stick in the holder. The material in the holder can include hard rubber or cork. The shape of the holder is a matter of design. Furthermore, the ashtray can contain a plurality of incense holders.

DETAILED DESCRIPTION OF THE INVENTION

Figure 1:
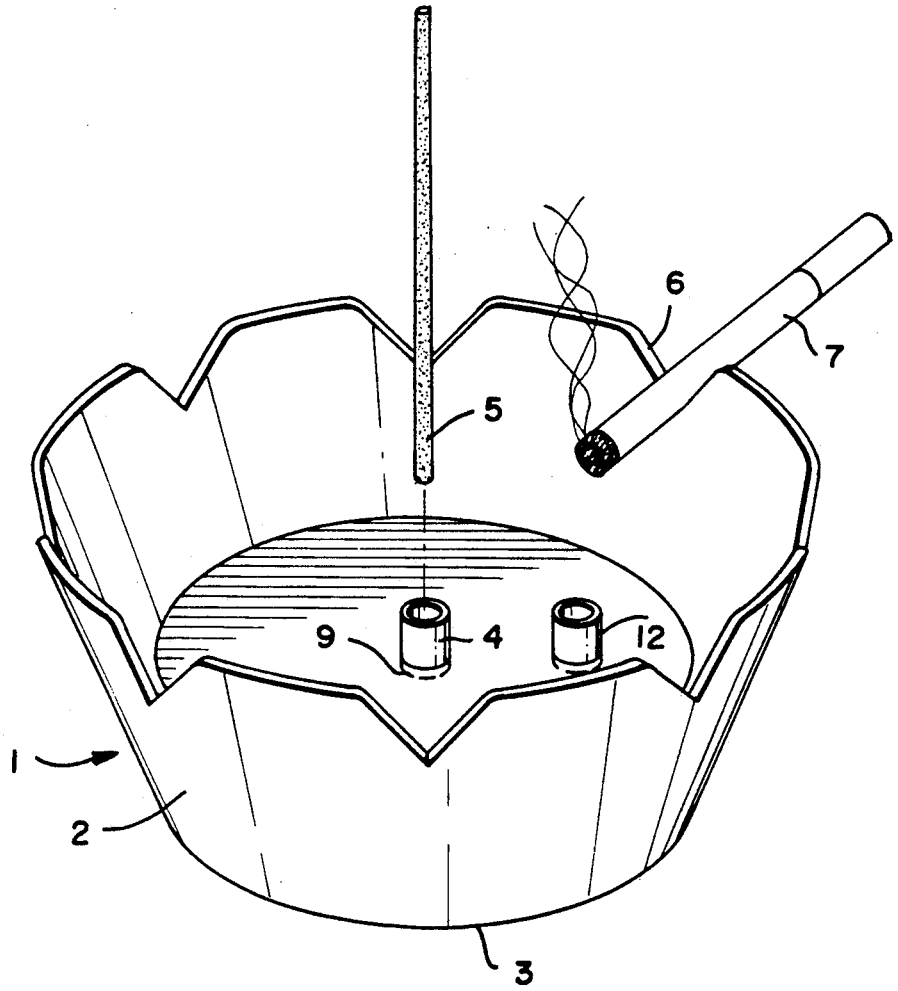
FIG. 1 illustrates an ashtray with an incense holder according to the invention.
Figure 2:
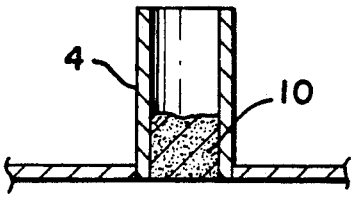
FIG. 2 illustrates a bottom view of an ashtray with a hole in the center.
Figure 3:
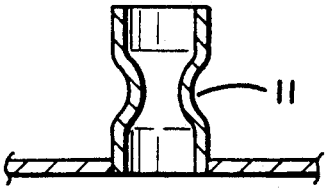
FIG. 3 illustrates an incense holder employing a holding medium inside the holder.

FIG. 1 illustrates an ashtray; (1) An ash receiving means is defined by that area bounded by the interior of wall (2) and base (3). A tube or incense holder (4) is attached to the base of the ashtray by attachment means (9). The tube can contain cork or rubber. The cork or rubber (10) is illustrated in FIG. 2. The purpose of the cork or rubber is discussed above. FIG. 3 illustrates a crimped incense holder (11). In use, an incense stick (5) is inserted into the incense holder (4) or (11). If it is inserted into holder (4), the clay or rubber would aid in supporting the stick (5). If it is inserted into holder (11), the crimp portion of said holder would aid in supporting the stick (5). Furthermore, as illustrated in FIG. 1, an additional incense holder (10) could be employed. If additional holders are employed, all the holders could be the same or they could be different.

What is claimed is:

1. An ashtray comprising:

(a) ash receiving means having a base;

(b) at least one incense stick;

(c) at least one incense holding tube provided with a crimp for holding the incense stick;

(d) an attachment means for attaching said tube to the base of the ashtray.

2. An ashtray comprising:

(a) an ashtray receiving means having a base;

(b) at least one incense stick;

(c) at least one holding tube provided with a solid insert therein that is penetrable by the incense stick, said solid material holds said incense stick in place;

(d) an attachment means for attaching said tube to the base of the ashtray.

* * * * *